United States Patent [19]

Kindmann et al.

[11] Patent Number: 5,027,713

[45] Date of Patent: Jul. 2, 1991

[54] TRACK SUPPORT FOR MAGNETIC RAILROADS AND SIMILAR RAIL-BORNE TRANSPORTATION SYSTEMS

[75] Inventors: Rolf Kindmann, Lünen; Gert Schwindt, Gröbenzell, both of Fed. Rep. of Germany

[73] Assignee: Thyssen Industries AG, Essen, Fed. Rep. of Germany

[21] Appl. No.: 472,830

[22] Filed: Jan. 31, 1990

[30] Foreign Application Priority Data

Feb. 1, 1989 [DE] Fed. Rep. of Germany ..... 3902949

[51] Int. Cl.[5] ..... B61B 5/00

[52] U.S. Cl. ..... 104/124

[58] Field of Search ..... 238/14.05, 14.4, 119, 238/7, 115, 116, 117, 119, 25, 26; 104/125, 281, 282, 286, 294, 124; 198/619

[56] References Cited

U.S. PATENT DOCUMENTS

| | | | |
|---|---|---|---|
| 3,771,033 | 11/1973 | Matsui et al. | 104/282 |
| 3,892,185 | 7/1975 | Guderjahn | 104/286 |
| 3,920,182 | 11/1975 | Molyneux | 238/115 X |
| 3,930,451 | 1/1976 | Huebner et al. | 104/294 X |
| 3,967,561 | 7/1976 | Schwärzler | 104/286 X |
| 4,216,904 | 8/1980 | Vivion | 238/117 X |
| 4,703,890 | 11/1987 | Tognoli et al. | 238/7 |

FOREIGN PATENT DOCUMENTS

| | | | |
|---|---|---|---|
| 0151283 | 12/1984 | European Pat. Off. . | |
| 2744367 | 5/1979 | Fed. Rep. of Germany . | |
| 53317 | 4/1977 | Japan | 104/281 |
| 1419565 | 12/1975 | United Kingdom | 238/115 |

OTHER PUBLICATIONS

Transrapid 07 Europa at the International Exposition in Hamburg, Schwindt et al., The Steel Gudeway.

*Primary Examiner*—David A. Bucci
*Assistant Examiner*—Craig Slavin
*Attorney, Agent, or Firm*—McGlew & Tuttle

[57] ABSTRACT

A track support which comprises steel structures (3) which are connected to reinforced concrete (1) or prestressed concrete (1) by connecting means (4) in a shear-free manner to form a composite support. The functional components, i.e., the lateral guide rails (3), are welded durably to the steel structures (3) at the upper chord (10) of the track support. In addition, it is possible to make continuous supports of great length from a plurality of individual supports at low cost by connecting the steel structures (3).

5 Claims, 4 Drawing Sheets

TRACK SUPPORT FOR MAGNETIC RAILROADS AND SIMILAR RAIL-BORNE TRANSPORTATION SYSTEMS

FIELD OF THE INVENTION

The present invention pertains to track supports for magnetic railroads and similar rail-borne transport systems on which the stators of linear motors can be fastened and which take up all the loads, especially as a consequence of carrying, guiding, driving, deceleration, and settling of the vehicles.

BACKGROUND OF THE INVENTION

Magnetic railroads of the above-described class reach very high travel speeds of up to 500 km/h. The magnetic railroad vehicles travel on track supports which in turn lie on pillars and/or foundations set up on subsoil (ground).

The track supports must guarantee that all the loads occurring during travel can be supported and reliably transmitted into the substructures (pillars and foundations) and the subsoil.

Because of the high travel speeds and the requirements imposed in terms of travel comfort, the track supports must very closely follow the predetermined route in terms of the location of the line and the gradients (i.e., the nominal line of the track). This applies especially to the accuracy of location of the functional surfaces and functional components which are required for travel on the track supports.

The track supports require essentially the following functional surfaces and components for the magnetic train operation:

- side guide rails whose distance forms the gage,
- sliding planes for depositing the vehicle, and
- structural components to which the stators of linear motors are fastened by means of which the magnetic effect is produced.

The prior art track supports consist of steel beams or prestressed concrete beams.

Two fundamentally different designs of track supports made from steel are known. In one of the prior art embodiments, the above-mentioned three functional components are three individual parts which must be connected to each other and to the steel track supports by means of bolts in extremely accurate positions. In the second embodiment, known from DE-C-3,404,061, the above-mentioned three functional components are integral parts of the welded steel track support.

The prior art track supports made from concrete consist of prestressed concrete beams, in which steel anchor bodies, which serve as structural components for connecting (fastening) the stators in the correct position, are embedded in concrete. The steel side guide rails are mounted in a subsequent, separate operation after producing the prestressed concrete beams.

It was found in the prior art prestressed concrete beams discussed that fastening the steel side guide rails to the prestressed concrete beams is very expensive, and the durability of the connection does not meet the requirements imposed. This equally applies to the design and the ability to function of the sliding planes.

The steel support design with the functional components bolted onto it requires very high expenditures for production and corrosion protection. Even though the all-welded steel support design is more favorable in terms of corrosion protection, the high accuracy of location required for the functional components can be achieved only with expensive measures in production, just as in the case of the prestressed concrete supports.

Besides the inevitable work tolerances, the thickness tolerances of the steel lateral guide rails, which occur during the production of these rails in the roll mill, are the essential cause for the necessary measures in the manufacture of the track supports. These thickness tolerances are already on the same order of magnitude as the tolerances allowable for the finished track support structure.

Further essential factors to be taken into account in designing and manufacturing the track support are the absolute necessity to conform with the nominal shape of the track and the deformations occurring as a consequence of traffic loads and different temperature distributions in the supports, which are caused, e.g., by exposure to sunlight. Furthermore, the deformations of the track support must be reduced to a minimum because of the high travel speeds and the required travel comfort.

SUMMARY AND OBJECTS OF THE INVENTION

It is an object of the present invention to provide a track support that possesses favorable properties in terms of the load-bearing and deformation characteristics, requires no maintenance for the longest possible time, and whose nominal shape can be realized with high accuracy in an inexpensive production process.

This task is accomplished in a track support of the class mentioned in the introduction in that the track support consists of steel structures, which are connected to reinforced concrete or prestressed concrete by connecting means to form a shear-free composite support, and that the lateral guide rails of the track support are welded to the steel structures.

Due to the shear-free connection of the steel structures to reinforced concrete or prestressed concrete, a composite support is obtained which has greater rigidity than steel supports, which reduces the deformation caused by traffic loads. The deformations caused by differences in temperature distribution in the track support (e.g., due to exposure to sunlight) are also smaller, because the concrete brings about a more uniform temperature distribution.

Welding the lateral guide rails to the steel structures of the support represents reliable connection with long service life. In addition, the steel structures of the track support can be prefabricated individually and be used as molds or molding aids during concreting. The rolling tolerances of the steel lateral guide rails can thus be eliminated and the nominal shape of the track support can be realized with certainty at low cost if adjustable devices with lateral stops are used.

In addition, composite supports have lower weight than prestressed concrete supports. This offers advantages for production, for outfitting with stators (linear motor) and for installation at the construction site, because the transportation equipment and the lifting means can be designed for lower capacities.

The use of steel pins, instead of reinforcing rods or welded wire fabrics, makes it possible to use a simple and reliable method for increasing the tensile strength of the concrete, especially in poorly accessible areas. There are poorly accessible areas, e.g., at the lateral guide rails and sliding planes (at the upper chord) and in the area of the bottom chord.

By incorporating prestressing elements in the concrete the nominal shape of the track support can be achieved by subsequent stressing if the nominal shape has not been achieved with sufficient accuracy during the production process.

The use of prefabricated concrete parts has the advantage that these can be manufactured fully independently from the rest of the support structure and that the reductions in length caused by shrinkage of the concrete have already taken place and have been completed during interim storage. Without a storage time, the reductions in length must be taken into account as planned deformations of the track support. The maximum weights to be transported and lifted can also be reduced by the use of prefabricated concrete parts, which is significant considering the long track lines to be built.

By connecting two or more track supports, whose length and weight are limited, it is possible to erect so-called continuous supports at the construction site, which are supported by more than two support points (pillars, foundations) in the longitudinal direction. The deformations caused by traffic loads and differences in temperature distribution are substantially smaller in continuous supports than in single-field supports (with only two pillars). It was found that it is not necessary to connect the concrete parts to achieve the continuous support effect, and connecting the steel parts of the adjoining track supports by welding or bolting is sufficient. Continuous supports of great length are thus obtained, in which the weight and the length of the individual supports to be transported to the construction site remain below the current economically acceptable limits for transportation and assembly at the construction site.

FIG. 1 is a cross sectional view of a composite track support with a concrete slab at the upper chord and a concrete body at the bottom chord, FIG. 2 is a view of composite track support according to FIG. 1, with a modified design in the area of the sliding planes and the lateral guide rails and without a concrete body at the bottom chord, FIG. 3 is a schematic representation of the production process, and FIG. 4 is a cross sectional view of a composite track support with a continuous cover plate.

DETAILED DESCRIPTION OF THE PREFERRED EMBODIMENTS

Figure 1:
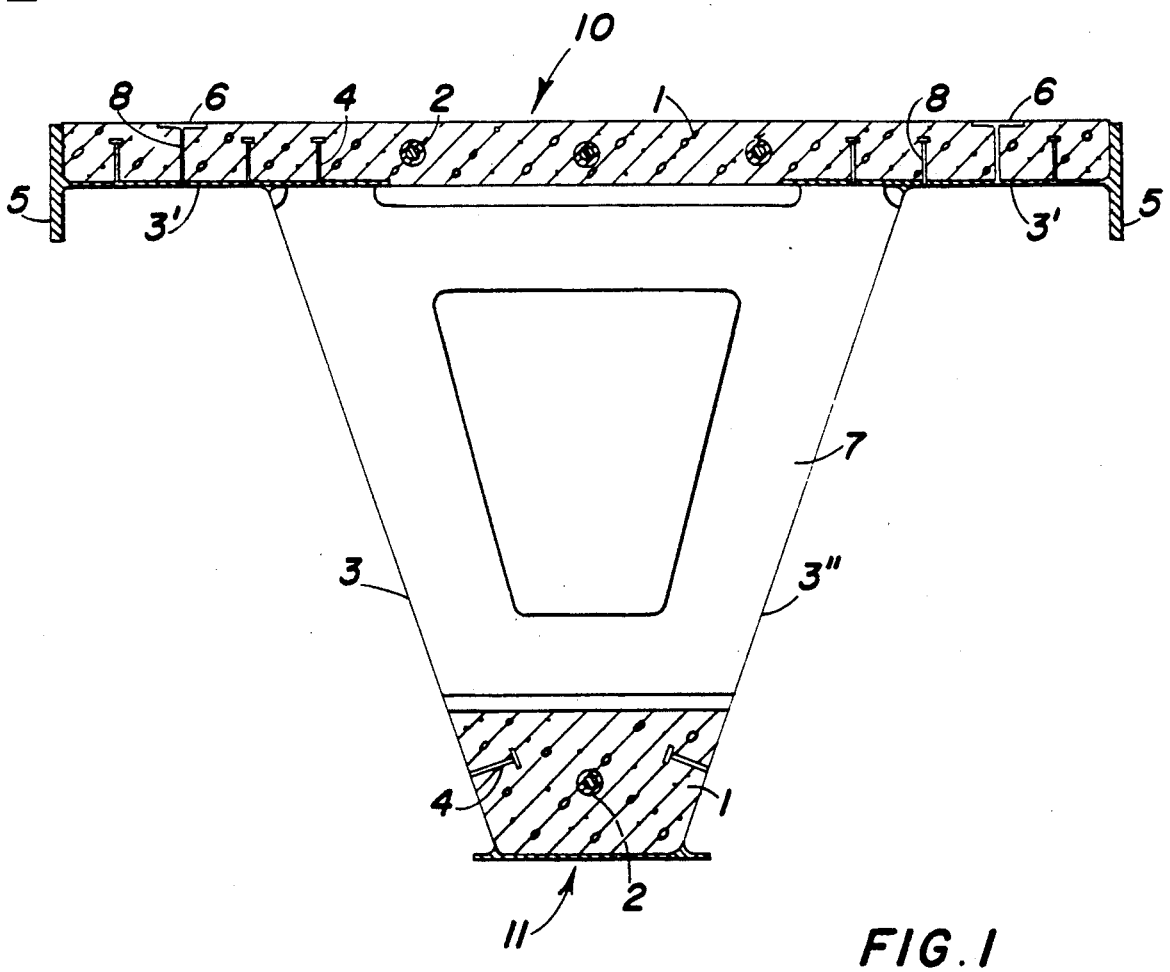

FIG. 1 shows the cross section of a composite track support. The concrete slab 1 at the upper chord 10 and the concrete slab 1 at the bottom chord 11 are connected with great rigidity to the steel structures generally designated 3 by connecting means 4 to form a shear resistant composite structure. The steel structures 3 located under the upper chord 10 consists of two lateral longitudinal plates which are welded to transverse bulkheads 7, so that, together with the bottom chord, it forms a type of trough. A composite support structure with very high load-bearing capacity is thus obtained. The lateral guide rails 5 are rigidly welded to the two steel structures 3' two lateral longitudinal plates of the upper chord 10. It is thus guaranteed that the gage will be accurately maintained in a particularly durable connection. The prestressing elements 2 can be used to increase the load-bearing capacity, to reduce the sag caused by the creep of the concrete, and to subsequently correct the shape of the support. Steel plates are used as the sliding planes 6, and the spacers 8 of these steel plates also serve as connecting means.

The time-dependent sag as a consequence of shrinkage of the concrete is eliminated nearly completely by arranging concrete 1 on the upper chord *and* the bottom chord 10, 11.

Figure 2:
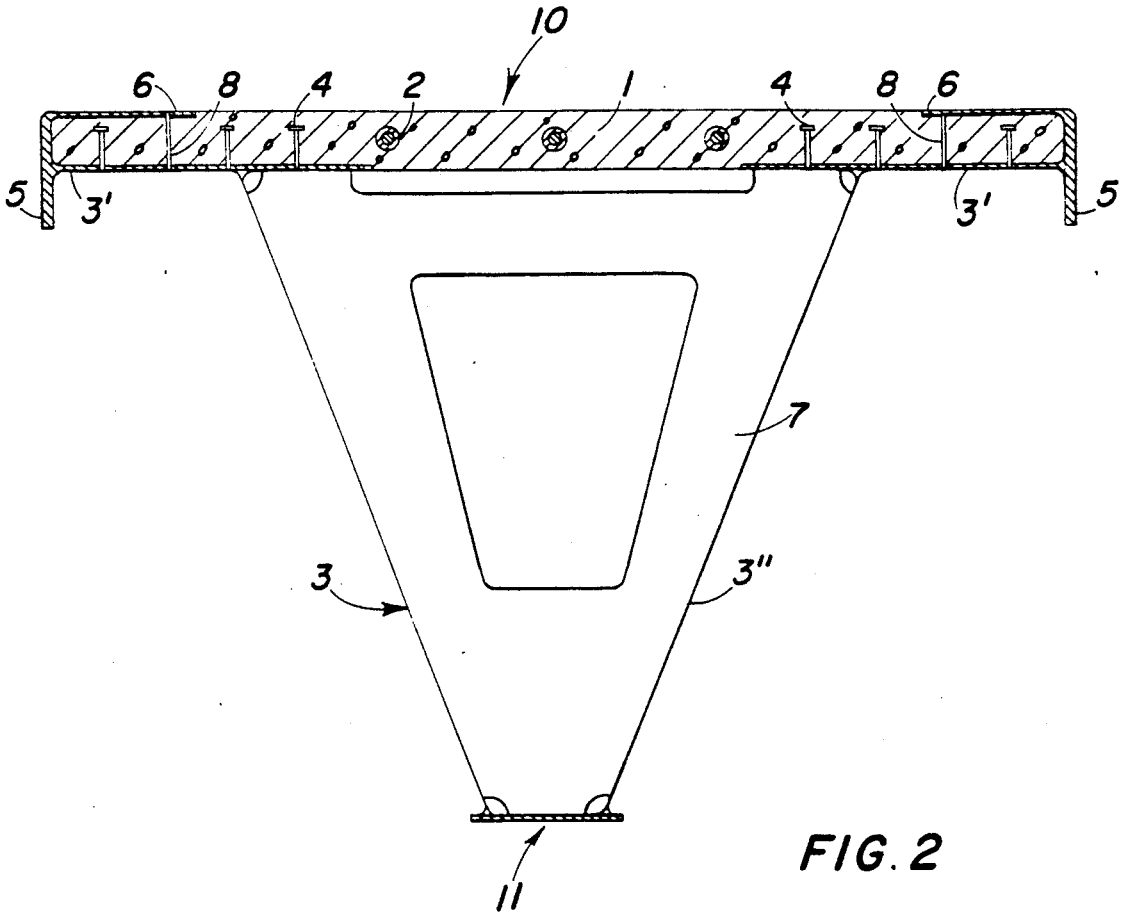

FIG. 2 shows a composite support structure for the track, which differs from the structure shown in FIG. 1 in the area of the functional components (lateral guide rail 5, sliding plane 6) and the bottom chord 11. A plate, which distributes the load and also contains the two sliding planes 6, is welded at the top end of the lateral guide rails 5 perpendicularly to the rails. This design is more favorable for durability than the solution shown in FIG. 1. The use of concrete 1 which is reinforced with steel pins rather than the conventional reinforcing rods or welded wire fabrics, is especially useful because of the limited space available. The bottom chord 11 consists a of steel plate and has no concrete body. The support is to be produced with a corresponding excess length. Most of this excess length is abolished by the shrinkage of the concrete 1 in the upper chord 10 by the time the support is put into operation. A bottom chord 11 without concrete can also be used in the design according to FIG. 1.

Figure 3:
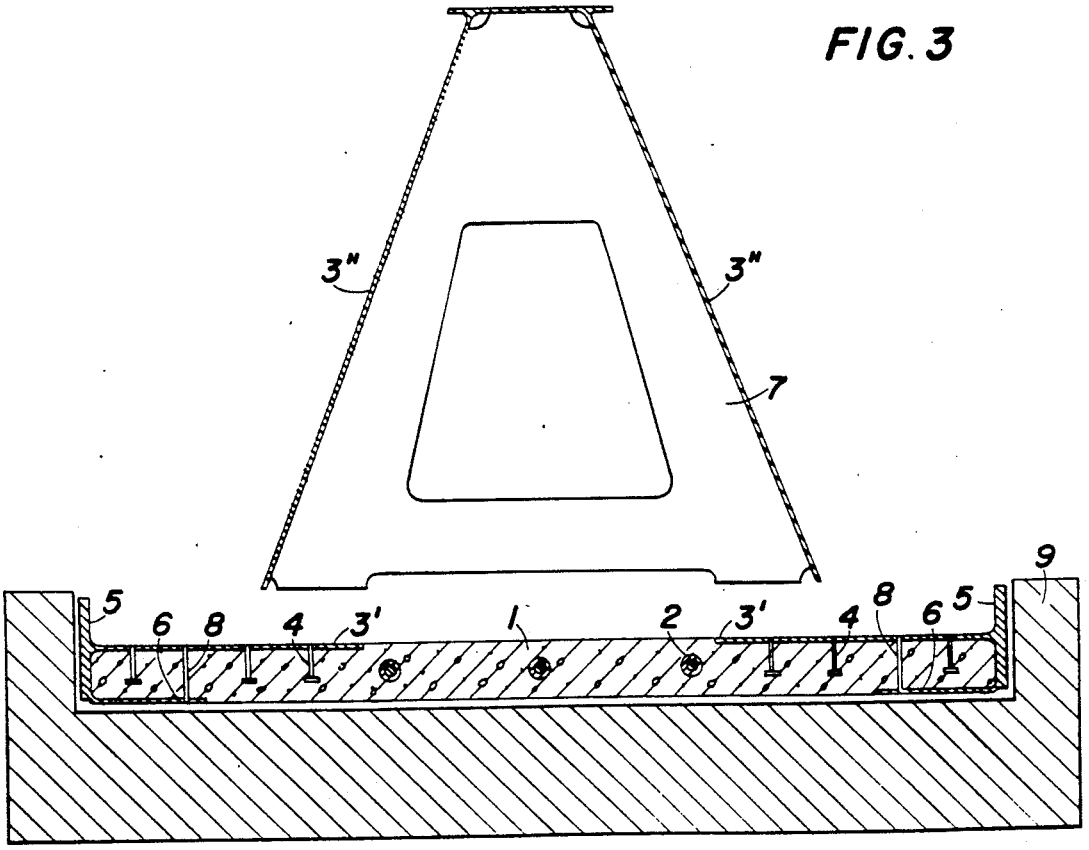

FIG. 3 illustrates the advantages achieved in the production of the composite support structure according to the present invention. The production is carried out in the position rotated through 180° and in devices 9, whose dimensions can be adjusted or selected (which is not represented in the drawing) so that the nominal shape of the composite structure can be preset with them. Since the lateral guide rails 5 are part of two separate lateral longitudinal plates 3' of the steel structures 3, they can be fixed on the lateral stops of the devices 9. The inevitable thickness tolerances of the lateral guide rails 5, which result from the rolling process, are thus eliminated, so that conformity with the gage defined by the distance between the two lateral guide rails 5 is guaranteed.

The adjustable devices 9 and the two lateral longitudinal plate 3' of the steel structures 3 (with the parts 4 through 6 and 8) are used as molds for the subsequent concreting of the concrete slab 1. The other, trough-shaped steel element 3'' of steel structures 3 is formed with transverse bulkheads 7 made of steel is manufactured in separate devices. This trough-shaped steel structure 3'' of steel structures 3 can be welded to the two lateral longitudinal plates 3' of steel structures 3 with the lateral guide rails 5, which two lateral longitudinal plates of the steel structures are connected to the concrete slab 1, because only the work and assembly tolerances of the steel structure are to be conformed with.

Figure 4:
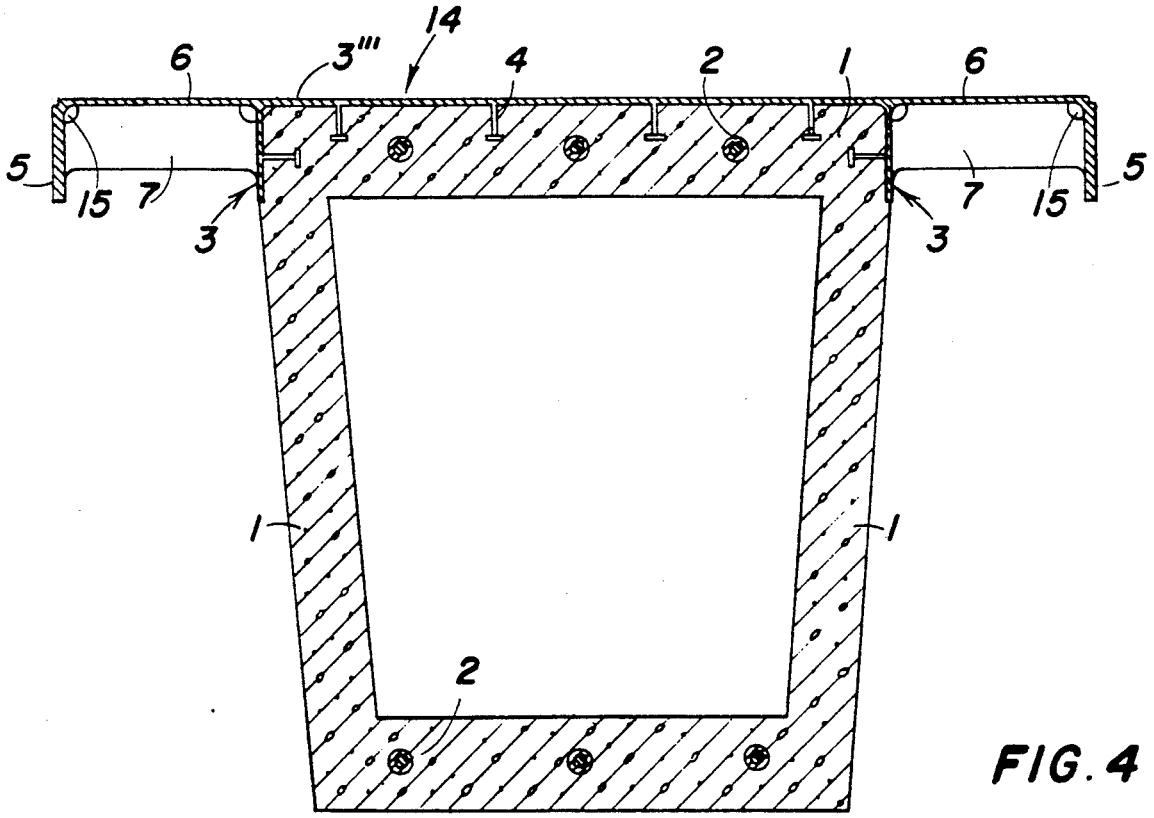

In the cross section of the composite track support which is shown in FIG. 4, the two lateral guide rails 5 are welded to a continuous cover plate 14, to which the fastening means 4 are also fastened, preferably welded. As is immediately apparent from FIG. 4, elimination of the thickness tolerances of the lateral guide rails 5 is guaranteed by the location of the weld seams 15 and their shape. The concreting of the concrete body 1 can subsequently be carried out according to the processes commonly employed in construction industry practice, using the steel structure 3 partially as the mold. In the embodiment according to FIG. 4, the functional components and functional surfaces (lateral guide rails 5 and sliding planes 6) are integral parts of a continuous (onepiece) steel structure 3'''. This also offers considerable advantages for the durability of the track support in view of the fact that the supports will be subject to all atmospheric effects for several decades during the subsequent travel operation.

Stators (armature stampings) with cable windings arranged in their slots are fastened in the correct location on the structural components mentioned on page 2, which usually consist of a steel plate in the vicinity of the two lateral guide rails 5, so that the electrical traveling field and the magnetic effect supporting the vehicle can be generated. These structural components (steel plates) are welded to the composite support, preferably on a suitable part of the composite support, e.g., on a spacer 8, or they form, e.g., a downwardly projecting part of a spacer 8. The composite support according to the present invention improves the long-term constancy of the relative location of the stators in relation to the other functional components, i.e., the lateral guide rails 5 and the sliding planes 6.

While specific embodiments of the invention have been shown and described in detail to illustrate the application of the principles of the invention, it will be understood that the invention may be embodied otherwise without departing from such principles.

We claim:

1. A track support arrangement for magnetic levitation rail vehicles, comprising: a steel structure including laterally extending longitudinal steel plates welded to a steel structure element for accepting a vertical load; horizontal slabs comprised of reinforced concrete or prestressed concrete; connecting means for connecting said horizontal slabs to said steel structure element and said steel plates to form a composite rigid structure resistant to shear; steel lateral guide rails welded to the horizontal part of said laterally extending longitudinal steel plates at an upper outer end of said steel structure.

2. A track support arrangement according to claim 1, wherein said composite rigid structure and said lateral guide rails form a prefabricated track support, two or more prefabricated track supports being connected by one of welding or bolting of a plurality of said steel structures to form a continuous support.

3. A track support arrangement according to claim 1, wherein said concrete is reinforced with steel pins to increase its tensile strength.

4. A track support arrangement according to claim 1, wherein said concrete includes prestressing elements incorporated in the concrete, said prestressing elements may be stressed after forming said composite structure.

5. A track support arrangement according to claim 1, wherein said concrete parts are formed as prefabricated concrete parts with steel parts imbedded in the concrete, said imbedded parts being connected to said steel structure to form said shear resistant composite rigid structure.

* * * * *